United States Patent [19]

Lumelsky

[11] Patent Number: 4,783,652

[45] Date of Patent: Nov. 8, 1988

[54] RASTER DISPLAY CONTROLLER WITH VARIABLE SPATIAL RESOLUTION AND PIXEL DATA DEPTH

[75] Inventor: Leon Lumelsky, Stamford, Conn.

[73] Assignee: International Business Machines Corporation, Armon, N.Y.

[21] Appl. No.: 900,014

[22] Filed: Aug. 25, 1986

[51] Int. Cl.[4] ..... G09G 1/16

[52] U.S. Cl. ..... 340/801; 340/750; 340/747; 358/283

[58] Field of Search ..... 340/703, 747, 750, 798, 340/801, 728; 358/283

[56] References Cited

U.S. PATENT DOCUMENTS 4,236,228 11/1980 Nagashima et al. .
4,500,875 2/1985 Schmitz ..... 340/703
4,683,466 7/1987 Holtey et al. ..... 340/703

*Primary Examiner*—Marshall M. Curtis
*Attorney, Agent, or Firm*—Sughrue, Mion, Zinn, Macpeak & Seas

[57] ABSTRACT

A display controller provides multiple different resolutions by selectively enabling different combinations of shift registers between the frame buffer and video look-up tables (VLTs). The VLTs are partitioned, with different partitions being programmed identically in accordance with the values of only the number of address bits which will be active from the shift registers at any one time.

12 Claims, 3 Drawing Sheets

RASTER DISPLAY CONTROLLER WITH VARIABLE SPATIAL RESOLUTION AND PIXEL DATA DEPTH

BACKGROUND OF THE INVENTION

The present invention relates to the control of data to a two-dimensional display screen, e.g., on a computer monitor. More particularly, the present invention is directed to a technique for providing a variable resolution display.

Computers commonly operate in different display modes with different display characteristics, in accordance with the requirements of the data being displayed. For example, a typical computer may operate its display in either a text or graphics mode, and may be capable of several different types of graphics modes. Bit plane graphics provides the least expensive way of displaying information on the screen, simply storing one bit for each pixel. However, the versatility of the display is not very good, since the allocation of only one bit per pixel means that no shading can be shown.

Gray scale level displays require more memory to store an image of the same resolution. E.g., by allocating four bits per pixel, each pixel can be shown in sixteen different levels of shading, thus increasing the versatility in what kinds of displays can be provided. For the same resolution, however, a gray level display with four bits per pixel will require a frame buffer which is four times as large as that required for a bit plane graphics display.

Finally, color displays typically allocate between four and eight bits per pixel to allow any given pixel to be represented in a large number of different color shades. To provide the same level of resolution as above, the frame buffer for a color display would necessarily be four to eight time larger than for a bit plane graphics system.

It would be desirable to provide a universal display controller capable of operating in each of the three different modes, but a number of problems are encountered. If the same spatial resolution is required for each different mode, the only approach would be to provide a frame buffer of maximum size which could provide high resolution images even in a color display having a "depth" of eight bits per pixel. Such an arrangement, however, would be expensive not only due to the cost and size of the frame buffer, but also as a result of the very high cost of high resolution color monitors as compared with gray level or black-and-white (B&W) monitors of the same resolution. As a practical matter, there is not often a requirement for equal resolution in both B&W and color modes. Moderately priced systems may include a high resolution B&W monitor and lower resolution color monitor. Higher priced systems may also utilize monitors with different resolutions, since B&W monitors in general provide higher resolution than the best color monitors. It is therefore desirable to provide a means for operating at different display resolutions.

Examples of display controllers adaptable to different resolutions are disclosed in U.S. Pat. Nos. 4,500,875 to Schmitz and 4,236,228 to Nagashima et al. The latter discloses a technique whereby a slow addressing method is used to assist the microprocessor in appropriately addressing a memory location, but this is not practical for providing fast video refresh. The former reference discloses a technique wherein a plurality of gates are provided in the video data path between the frame buffer and color map memory. This is disadvantageous not only due to the complexity of the gate array but also in that the different propagation paths through the gate array must be very short and of equal propagation delay, requiring further complex hardware to ensure satisfaction of the timing requirements.

A display controlling with a permanent frame buffer configuration requires a very large frame buffer size to handle both requirements of high resolution and of maximum pixel depth. It is possible to provide additional hardware to reconfigure the frame buffer structure for particular applications, but such additional hardware would be quite expensive.

SUMMARY OF THE INVENTION

It is, therefore, an object of the present invention to provide a display controller capable of variable spatial resolution and variable pixel data depth.

It is a further object of this invention to provide such a system which avoids the use of costly additional frame buffer reconfiguration hardware.

It is a feature of the present invention that the frame buffer is software-reconfigurable using a Video Look-up Table (VLT). Briefly, the present invention employs a frame buffer configured for the maximum pixel data depth data mode, and a VLT for receiving the frame buffer output data and providing appropriate pixel data through a digital-to-analog (D/A0 converter to the monitor. If a color monitor is used, separate VLTs may be used for each color. All VLTs are divided into partitions which are programmed identically. A plurality of shift registers are used to pass the data from the frame buffer to the VLTs. The shift registers are arranged such that their collective outputs at any given time will represent a multi-bit address word to the VLT. The shift registers are provided with separately controllable Clear inputs so that the effective depth of the pixel data can be varied in accordance with the display mode. For example, with a maximum pixel depth of eight bits per pixel, all eight shift registers may be used to provide data to the VLTs. In a higher resolution mode, the pixel depth may be four bits per pixel. This is accomplished by reading through a column or row of the frame buffer twice, the first time utilizing half of the shift registers to provide half of the data to the VLTs, and the second time using the other half of the shift registers to provide the other half of the frame buffer data to the VLTs. For a frame buffer configured for a pixel depth of eight bits, it is possible to increase the display resolution by a factor of eight by reading out only one bit per pixel.

BRIEF DESCRIPTION OF THE DRAWINGS

The invention will be more clearly understood from the following description in conjunction with the accompanying drawings, wherein.

DETAILED DESCRIPTION OF THE PREFERRED EMBODIMENTS

Figure 1:
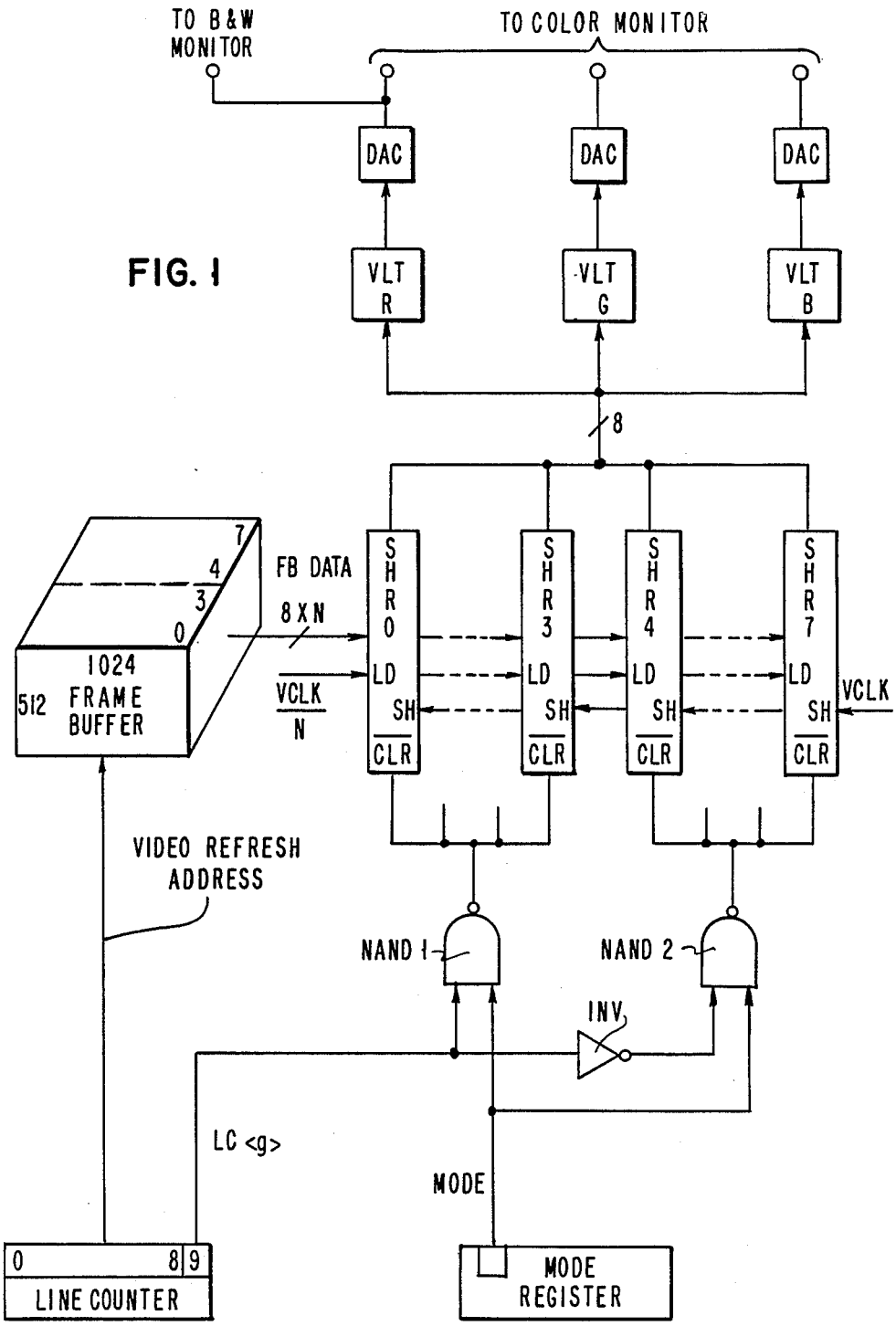
FIG. 1 is a block diagram of a display controller in accordance with a first embodiment of the present invention.

A relatively simple implementation of the present invention is represented by the embodiment of FIG. 1. In this embodiment, the frame buffer having an organization of 1024 (horizontal)×512 (vertical) by 8 (depth) can be also used to provide a resolution of 1024×1024 with a depth of 4 bits per pixel.

The system of FIG. 1 is a conventional display controlled with three VLTs (red, green and blue), a frame buffer, eight N-bit shift registers SHR0–SHR7. D/A converters for the outputs of each of the VLTs, and a line counter. The frame buffer may be a μpD 41264 video RAM made by NEC Corporation. The line counter provides nine bits (0–8) of its output as the vertical video-refresh address to the frame buffer. Each successive address from the bits 0–8 of the line counter addresses one of the 512 lines, or rows, of the frame buffer, with each row including 1024 8-bit pixel data values. In a known manner, the 8 bits of each pixel data value can be read out in parallel, with each bit going to a respective one of the shift registers SHR0–SHR7. These N-bit shift registers are loaded in response to a signal (VCLK/N) applied to their load terminals LD, so that N pixel values are taken from the frame buffer at each load signal (VCLK/N), where N is a ratio between the video clock VCLK frequency and the frame buffer video refresh read-out period. Between each load signal, N pulses of the video clock VCLK occur, shifting out in parallel the contents of all registers SHR0–SHR7, with the collective outputs of the shift registers at any given time representing one of the 8-bit pixel data values provided in common to all of the VLTs.

In addition to the conventional structure, the device includes a one-bit Mode Register, two NAND gates and one inverter INV. In addition, the line counter includes an extra bit LC<9>. The "clear" inputs $\overline{CLR}$ of the shift registers SHR0–SHR3 are connected in common to the output of the gate NAND1, and the "clear" inputs of the registers SHR4–SHR7 are connected in common to the output of gate NAND2. For 512×1024 resolution, the mode register is set to a value of "0". This will cause the outputs of each of the gates NAND1 and NAND2 to be continually high, so that none of the shift registers SHR0–SHR7 are cleared. Once each count of the line counter, a new line in the frame buffer is accessed. Once each cycle of the load signal (VCLK/N), N 8-bit pixel data values are loaded in parallel into the registers SHR0–SHR7. The register contents are then shifted out in response to the video clock signal VCLK, with the collective outputs of the shift registers SHR0–SHR7 at any time representing one 8-bit pixel value. These 8-bit values are provided in common to all three VLTs. With each pixel value having a depth of 8-bits, the VLTs can cooperate to provide 256 different shades of color for each pixel. Alternatively, a B&W monitor may be used, e.g., operated in accordance with a gray scale.

If higher resolution is desired, this can be easily accomplished by effectively dividing the frame buffer into halves. More particularly, instead of operating the frame buffer as though each line includes 1024 columns which are 8-bits deep, the frame buffer is operated as two different 512×1024×4 buffers.

To operates in the 1024×1024 mode, the mode register is set to a value of "1". During a first pass through the frame buffer, the output bits 0–8 from the line counter sequentially step through all 512 lines of the frame buffer. At this time, the additional bit LC<9> is low, so that the output of NAND1 is high and the output of NAND2 is low. As a consequence, registers SHR4–SHR7 are kept cleared. Thus, when the 8-bit words are loaded in parallel across the 8 registers SHR0SHR7, the bits 4–8 are effectively ignored, with the 8-bit word subsequently provided to the VLTs comprising the output bits from SHR0–SHR3 as its four most significant bits and a value of "0" as its four least significant bits. During the next pass through the 512 lines of the frame buffer, the additional bit LC<9> has a value of "1", so that the output of NAND1 is low and the output of NAND2 is high. This time through, the registers SHR0–SHR3 are maintained cleared, while the bits 4–7 from each column of the frame buffer are provided through the registers SHR4–SHR7 as the four least significant bits of the address word to be provided to the VLTs. In this higher resolution mode, the four upper bits of the pixel data are equal to 0 during the first half of the frame period, and the four lower bits are equal to 0 during the second half. If VLT R is loaded in accordance with Table 1 set forth below, the data value provided at the output of the VLT will be determined in accordance with only those four bits from the shift registers SHR which are not cleared. The frame buffer data stored in bits 0–3 corresponds to the pixel values for the raster lines 0–511, while the data stored in the bits 4–7 correspond to the pixel values for the raster lines 512–1023. In this way, the output of VLT R is exactly the same as if the frame buffer would have been organized as a 1024×1024×4 memory.

The A(O) . . . A(F) data provided at the output of VLT R may represent image transformation data (e.g., gama correction data), or in the simplest case may simply be equal to the VLT location address (proportional output). As a result, the output of the D/A converter connected to VLT R can be used for a B&W monitor with double resolution. Of course, the vertical sync parameters should be mode-dependent as well, and this can be accomplished in a straightforward manner which need not be described in detail here.

TABLE 1

| Address | | |
|---|---|---|
| 7 . . . 4 | 3 . . . 0 | Data |
| 0 | 0 | A(0) |
| 0 | 1 | A(1) |
| 0 | 2 | A(2) |
| . | . | . |
| . | . | . |
| . | . | . |
| 0 | F | A(F) |
| 1 | 0 | A(1) |
| 2 | 0 | A(2) |
| . | . | . |
| . | . | . |
| . | . | . |
| F | 0 | A(F) |

No additional hardware is required for communication with the host processor. When the desired resolution is 512×1024, data can be written in complete 8-bit bytes. If the resolution is changed to 1024×1024, a read-modify-write mode can be used in order to write either the upper or lower four bits as desired.

As can be seen from the above description, a value of "0" in the mode register allows the frame buffer to perform as a 512×1024×8 buffer, thus giving a resolution of 512×1024 with 8 bits of depth per pixel. A mode register value of "1" permits the buffer to operate as a 1024×1024×4 buffer for a resolution of 1024×1024 and four bits of "depth" per pixel. The embodiment of FIG. 1 is thus easily implemented without excessive frame buffer storage requirements and without costly additional hardware, while providing a simple and effective technique for alternately operating a different resolutions.

Figure 2:
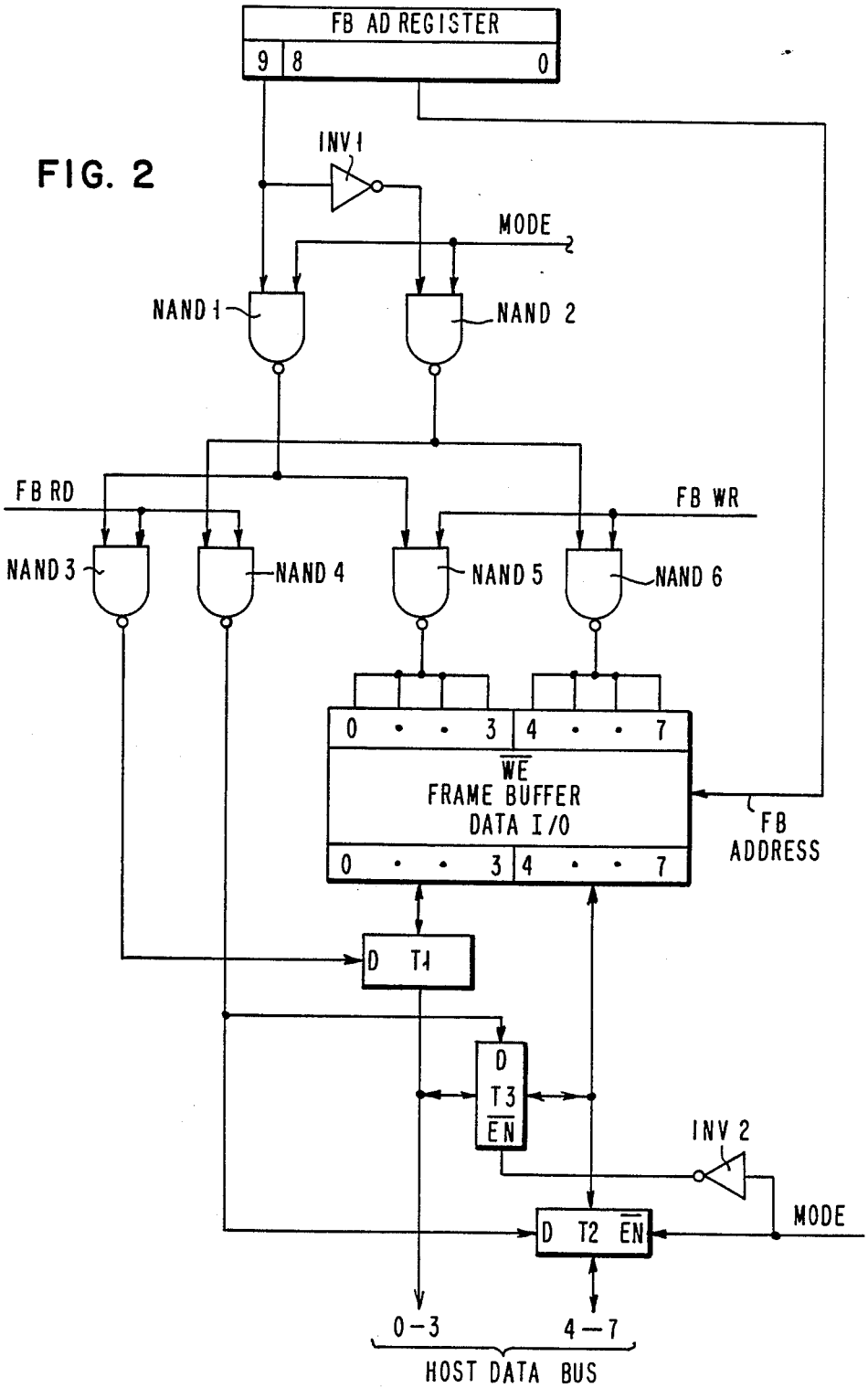
FIG. 2 is a block diagram of a display controller in accordance with a second embodiment of the present invention.

FIG. 2 illustrates a second embodiment of the invention which is useful if there exists a speed limitation which will not permit the use of a read-modify-write mode to separately maintain the upper and lower halves of the frame buffer during 1024×1024 operation. In FIG. 2, the frame buffer address register FBADREG serves the same function as the line counter in FIG. 1, with the first 9 bits (0–8) providing the line address to the frame buffer. The mode signal is provided from a mode register (not shown) as in the embodiment of FIG. 1. In this embodiment, the read signal FBRD is high during a frame buffer read operation, and the write signal FBWR is high during a frame buffer write operation. In addition, transceivers T1, T2 and T3 are provided between the frame buffer data I/O ports and the host data bus, with the direction of data transmission through the transceivers being controlled in accordance with the signal at the direction terminal D. (In some cases where it is unnecessary to change the width of the host data path to the frame buffer from 8 bits to 4 bits, these additional transceivers may be unnecessary.)

For MODE=0 operation for 512×1024 resolution with 8 bits of depth per pixel, the outputs of NAND1 and NAND2 are always high, and the transceiver T3 is disabled through the inverter INV2. During a read operation, the outputs of gates NAND3 and NAND4 are low so that each of transceivers T1 and T2 will pass data in the direction from the frame buffer to the host data bus. For a write operation, the outputs of gates NAND5 and NAND6 are both low, enabling the writing of data into all 8 bits of the frame buffer depth. The outputs of gates NAND3 and NAND4 are high, so that transceivers T1 and T2 pass all 8 bits of data in the direction from the host data bus to the frame buffer. For 1024×1024 resolution with a depth of 4 bits per pixel, the MODE signal is set to a value of "1", thus disabling transceiver T2 and enabling transceiver T3. For a read operation, the signals FBRD and FBWR are high and low, respectively. During the first 512-count cycle of the frame buffer address register bits 0–8, the additional bit will have a value of "0", so that the outputs of NAND1 and NAND2 will be high and low, respectively. As a consequence, the outputs of gates NAND3 and NAND4 will be low and high, respectively. Transceiver T1 will pass the frame buffer bits 0–3 to the host data bus. Transceiver T3 will pass the same bits back to the I/O ports for bits 4–7, but this will be of no consequence since the writing of data into the frame buffer will be disabled. During a second pass through the frame buffer, the additional bit in the frame buffer address register will be high, so that the outputs of gates NAND3 and NAND4 will be high and low, respectively. During this half of the frame period, the frame buffer output bits 4–7 are provided to the host data bus through the transceiver T3. Thus, the bits 0–3 on the host data bus will always represent the pixel data, and the frame buffer will appear to the host processor to operate as a 1024×1024×4 structure.

For a write operation in the high resolution mode, the signals FBRD and FBWR are low and high, respectively, so that the outputs of both of gates NAND3 and NAND4 will be high and the transceivers T1 and T3 will both pass data in the direction from the host data bus to the frame buffer data I/O ports. During a first pass through the 512 lines of the frame buffer, the additional bit in the frame buffer address register will have a low value, so that the outputs of gates NAND1 and NAND2 will be high and low, respectively, and the outputs of gates NAND5 and NAND6 will consequently be low and high, respectively. Thus, the four bits 0–3 of pixel data provided from the host data bus in common through the transceivers T1 and T3 can only be written into the bits 0–3 of the frame buffer. During the second half of the frame period, the additional bit in the frame buffer address register will have a high value, so that the outputs of gates NAND5 and NAND6 will be high and low, respectively, thereby permitting the four bits of data provided from the host data bus to be written only into the bits 4–7 of the frame buffer.

The embodiment of FIG. 2 is similar to that of FIG. 1 in that it is relatively easily implemented and provides an effective technique for operating in either a 512×1024×8 mode or 1024×1024×4 mode, without requiring either an excessive frame buffer storage capacity or complicated hardware for switching between different modes of operation. It should also be noted that the displayable image could be selected between these lower and higher resolution modes, e.g., 1024×800×4. This could be achieved by simply changing sync parameters and through corresponding adjustment of the sequence of the video refresh addresses.

Figure 3:
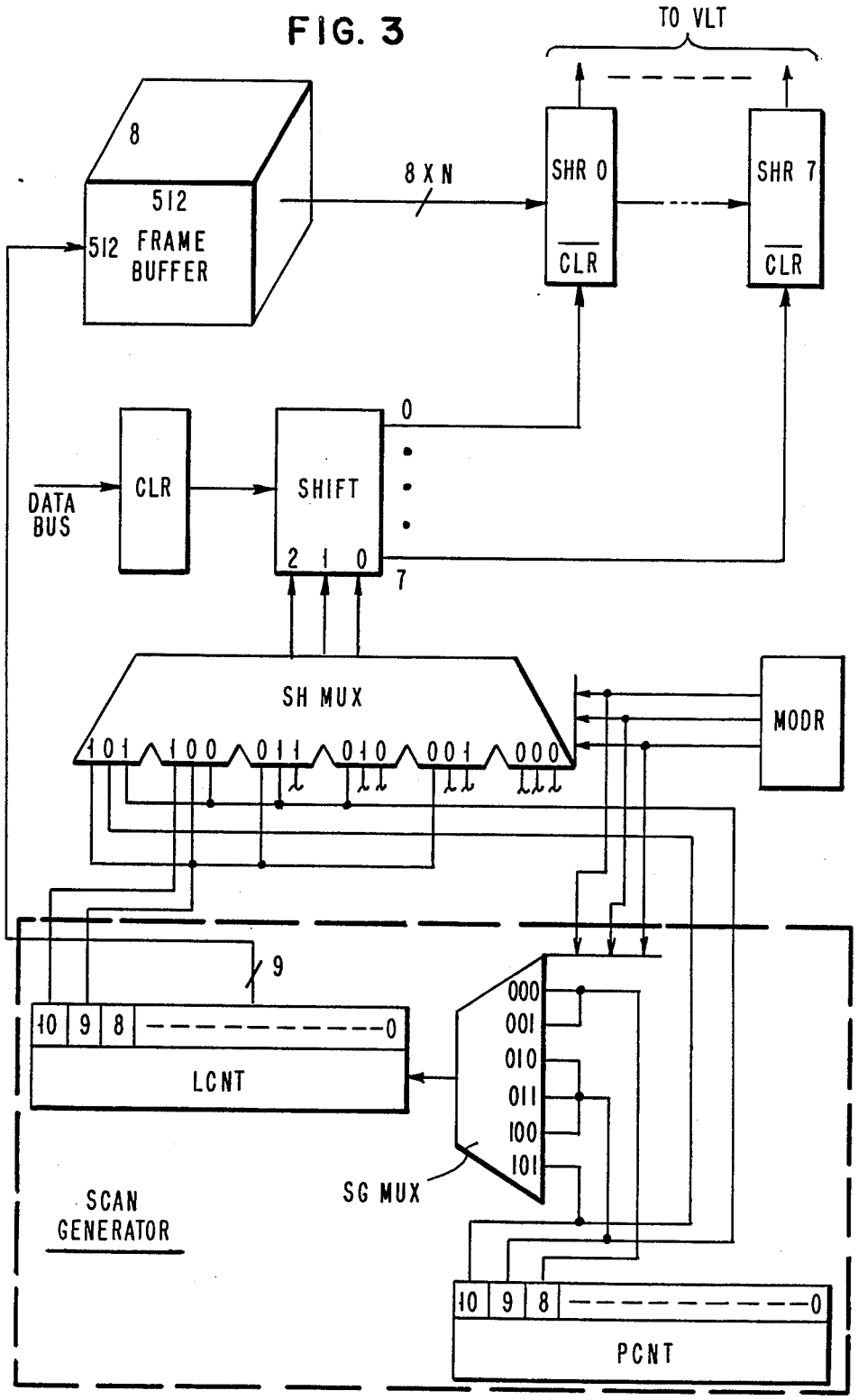
FIG. 3 is a block diagram of a display controller in accordance with a third embodiment of the present invention.

Turning now to FIG. 3, a third embodiment of the invention is illustrated for controlling spatial resolution in either direction. In the example of FIG. 3, the frame buffer structure is 512×512×8 bits, an again the buffer may be the NEC upD 41264 video RAM. As before, the frame buffer output is provided in parallel across 8 shift registers SHR0–SHR7 each having a separately controllable clear terminal $\overline{CLR}$. The embodiment of FIG. 3 further includes an 8-bit clear data register CLR, and a combinational shifter SHIFT the shift amount of which is controlled by a 3-bit shift signal SH.

In this embodiment, the mode register MODR is a three-bit register. As before, the line counter LCNT includes 9 bits (0–8) which provide the line count portion of the video refresh address to the frame buffer. The scan generator multiplexer SGMUX provides any one of the bits 8–10 of the pixel counter PCNT to the count input of the line counter LCNT, and the shift multiplexer SHMUX provides an appropriate 3-bit control signal SH to the shifter SHIFT. Both of the muliplexers SGMUX and SHMUX are controlled by the three-bit output from the mode register MODR.

The following Table 2 shows the various resolutions which are available, the data depth at each resolution, the corresponding mode register value and CLR data value.

TABLE 2

| Resolution | | Data Depth | MODR | CLR |
|---|---|---|---|---|
| Hor | Vert | bits | hex | hex |
| 512 | 512 | 8 | 0 | FF |
| 512 | 1024 | 4 | 1 | 0F |
| 1024 | 512 | 4 | 2 | 0F |
| 1024 | 1024 | 2 | 3 | 03 |
| 1024 | 2048 | 1 | 4 | 01 |

TABLE 2-continued

| Resolution | | Data Depth | MODR | CLR |
|---|---|---|---|---|
| Hor | Vert | bits | hex | hex |
| 2048 | 1024 | 1 | 5 | 01 |

For 512×512×8 operation, the data in the clear data register CLR is FF (hex), i.e., all zeros. Thus, regardless of the value of the shift signal SH, all outputs of the shifter SHIFT will be 0, and none of the registers SHR0–SHR7 will be cleared. Under control of the line counter, clocked by PCNT<8> byte-wide data will be read out of the frame buffer into the registers SHR0-SHR7 and will be provided from there to the VLTs.

For 512×1024×4 operation, the mode register is set to a value of 1 and the register CLR is set to a value of OF (hex), i.e., 00001111. Each line is read out once due to clocking of the line counter by PCNT<8>, but two passes are made through the lines to simulate 1024 vertical resolution. To read a different four bits during each pass through the 512 lines, the shift control signal SH is controlled by LCNT<9>. For example, when the first 512 lines are being displayed, LCNT<9>=0 so that the shift control signal SH is zero and SHR4–SHR7 are cleared. When the next 512 lines are being displayed, LCNT<9>=1 so that the shift control signal SH is 4 (hex) and SHR0–SHR3 are cleared.

For 1024×512×4 operation, the mode registration is set to a value of 2 (i.e., "010"), and the register CLR is again set to a value of OF (hex). With the mode register MODR having a value of "010", the shift control signal SH will be determined by PCNT<9>. The scan generator multiplexer SGMUX will pass PCNT<9> to the count input of the line counter LCNT so that each line will be read twice in succession during a single pass of the line counter through the 512 lines of the buffer this will simulate a buffer line length of 1024.

For 1024×1024 resolution, the pixel data depth is reduced to two bits, and the mode register MODR is set to a value of 3 (i.e., "011"), with the clear data register CLR being set to a value of 03 (hex), i.e., 00000011. The line counter LCNT is again clocked by PCNT<9> so that a line is read twice in succession for each LCNT output, and the SH signal to the shift register SHIFT will be represented by [LCNT9, PCNT9,, 0]. A timing sequence of the CLR signals and video refresh addresses corresponding to the 1024×1024×2 reorganization of the frame buffer is shown in the following Table 3. The row address is represented by the lower 9 bits of the line counter LCNT, with the column address being internally generated by the frame buffer. As can be seen from Table 3, a first pass through the 512 lines of the frame buffer is made, with each line being read out twice. During the first reading of each line, only SHR0 and SHR1 are used, with the remainder of the registers SHR2–SHR7 being kept cleared. During the second reading of each line, only registers SHR2 and SHR3 are not cleared. Next, a second pass through the 512 lines of the frame buffer is made, with each line again being read out twice. During the first reading of each line, only the registers SHR4 and SHR5 are not cleared, and during the second reading of each line only the registers SHR6 and SHR7 are not cleared. Thus, with two readings of each line, and two passes through the 512 lines, the 512×512×8 frame buffer is effectively operated as a 1024×1024×2 structure.

For 1024×2048×1 operation, the mode register MODR is set to a value of "100" with the clear data register CLR set to a value of 00000001. In this mode, each line is read twice to simulate a horizontal resolution of 1024, and four passes are made through the 512 lines of the frame buffer to simulate a vertical resolution of 2048. The shift signal SH is controlled by LCNT<10>, LCNT<9> and PCNT<9>.

Finally, for 2048×1024×1 operation, the mode register MODR is set to a value of "101" with the clear data register CLR having a value of 00000001. During a first pass through the 512 lines of the frame buffer, each line is read four times, passing a single different bit each of those four times. During a second pass through the 512 lines of the frame buffer, each line is again read four times, each time passing a single one of the remaining four bits of the buffer depth. This effectively goes through the 512 line of memory twice to simulate a vertical resolution of 1024, while reading each line four separate times to simulate a horizontal resolution of 2048.

As can be seen from the above description, the present invention provides a frame buffer architecture that can be used with a wide variety of monitors with different resolutions. The solution is most suitable for systems already using a video look-up table (VLT) for conventional purposes, e.g., gamma correction, color transformations, 2.5D graphics, etc. In such cases, the implementation requires very little additional hardware.

TABLE 3

| LCNT | PCNT<9> | SHR's CLR signals | | | | | | | | Video_refr_add | |
|---|---|---|---|---|---|---|---|---|---|---|---|
| <9 . . . 0> | <0> | 0 | 1 | 2 | 3 | 4 | 5 | 6 | 7 | RA | CA |
| 0 | 0 | 1 | 1 | 0 | 0 | 0 | 0 | 0 | 0 | 0 | 0 . . . 511 |
| 0 | 1 | 0 | 0 | 1 | 1 | 0 | 0 | 0 | 0 | 0 | 0 . . . 511 |
| 1 | 0 | 1 | 1 | 0 | 0 | 0 | 0 | 0 | 0 | 1 | 0 . . . 511 |
| 1 | 1 | 0 | 0 | 1 | 1 | 0 | 0 | 0 | 0 | 1 | 0 . . . 511 |
| 2 | 0 | 1 | 1 | 0 | 0 | 0 | 0 | 0 | 0 | 2 | 0 . . . 511 |
| 2 | 1 | 0 | 0 | 1 | 1 | 0 | 0 | 0 | 0 | 2 | 0 . . . 511 |
| . | . | . | . | . | . | . | . | . | . | . | . |
| . | . | . | . | . | . | . | . | . | . | . | . |
| . | . | . | . | . | . | . | . | . | . | . | . |
| 511 | 0 | 1 | 1 | 0 | 0 | 0 | 0 | 0 | 0 | 511 | 0 . . . 511 |
| 511 | 1 | 0 | 0 | 1 | 1 | 0 | 0 | 0 | 0 | 511 | 0 . . . 511 |
| 512 | 0 | 0 | 0 | 0 | 0 | 1 | 1 | 0 | 0 | 0 | 0 . . . 511 |
| 512 | 1 | 0 | 0 | 0 | 0 | 0 | 0 | 1 | 1 | 0 | 0 . . . 511 |
| 513 | 0 | 0 | 0 | 0 | 0 | 1 | 1 | 0 | 0 | 1 | 0 . . . 511 |
| 513 | 1 | 0 | 0 | 0 | 0 | 0 | 0 | 1 | 1 | 1 | 0. . . 511 |
| . | . | . | . | . | . | . | . | . | . | . | . |
| . | . | . | . | . | . | . | . | . | . | . | . |
| . | . | . | . | . | . | . | . | . | . | . | . |
| 1023 | 0 | 0 | 0 | 0 | 0 | 1 | 1 | 0 | 0 | 511 | 0 . . . 511 |

TABLE 3-continued

| LCNT | PCNT<9> | SHR's CLR signals | | | | | | | | Video_refr_add | |
|---|---|---|---|---|---|---|---|---|---|---|---|
| <9 . . . 0> | <0> | 0 | 1 | 2 | 3 | 4 | 5 | 6 | 7 | RA | CA |
| 1023 | 1 | 0 | 0 | 0 | 0 | 0 | 0 | 1 | 1 | 511 | 0 . . . 511 |

It should be noted that the embodiments disclosed above are by way of example only, and that various changes and modifications can be made to the invention without departing from the spirit and scope of the invention as defined in the appended claims.

I claim:

1. A display control apparatus for storing image data representing an image to be displayed and for providing display control data to a display means for displaying said image, said display control apparatus comprising:

storage means for storing said image data in a plurality of storage locations each having K bits;

reading means for reading said image data out of said storage means;

translation means for translating said image data into said display control data;

a plurality of shift register means for receiving the image data from said storage means and for providing said image data to said translation means when enabled; and control means for selectively enabling and disabling ones of said shift register means at a rate not exceeding K times per frame in accordance with a desired image resolution.

2. A display control apparatus as defined in claim 1, wherein said storage means comprises a memory having I lines and J columns of storage locations each for storing a pixel data value, with each storage location having K bits, and said shift register means comprise K shift registers each receiving a different one of said bits from each pixel data value read out of said storage means.

3. A display control apparatus as defined in claim 2, wherein said display control apparatus is capable of operating in a first resolution mode wherein all of said shift registers are enabled at one time, and at least one second resolution mode wherein at most L of said shift registers are enabled at one time, where $L<K$.

4. A display control apparatus as defined in claim 3, wherein said display control apparatus is capable of operating in a plurality of second resolution modes.

5. A display control apparatus as defined in claim 4, wherein said plurality of second resolution modes include different horizontal resolutions.

6. A display control apparatus as defined in claim 5, wherin said plurality of second resolution modes include different vertical resolutions.

7. A display control apparatus as defined in claim 3, wherein said reading means comprises address means for generating a multi-bit cyclical signal, with M bits being provided to said storage means as an address signal for reading out said image data and at least one additional bit for designating shift registers to be enabled during operation in said second resolution mode.

8. A display control apparatus as defined in claim 7, wherein said control means includes mode designation means for providing a mode signal indicating the desired resolution mode, and logic means responsive to said mode signal and to the value of said additional bit for selectively enabling and disabling said shift registers.

9. A display control apparatus as defined in claim 2, wherein said translation means comprises at least one memory addressed by the collective outputs of said plurality of shift registers, said at least one memory, in said second resolution mode, storing display control values corresponding to the address value represented by the L shift registers which are enabled at one time, whereby identical display control values are stored at different locations in said at least one memory.

10. A display control apparatus as defined in claim 1, wherein:

said storage means comprises a buffer memory having I lines and J columns of storage locations each for storing a pixel data value, with each storage location having K bits, said buffer memory having separately controllable write enable terminals corresponding to each of said K bits for enabling the writing of data into a respective bit position in accordance with write enable signals, and data Input/Output (I/O) ports for providing data to and from said buffer;

said display control apparatus is capable of operating in a first resolution mode in which all shift registers are enabled at one time and a second resolution mode in which less than all of said shift registers are enabled at one time, said reading means comprises address means for generating a multi-bit cyclical signal, with M bits being provided to said storage means as an address signal for reading out said image data and at least one additional bit for designating shift registers to be enabled during operation in said second resolution mode, and means for providing a read signal designating a read operation;

said display control device further includes means for providing a mode signal designating a desired resolution mode, means for providing a write signal designating a write operation, transceiver means coupled between said data I/O ports and a host processor data bus for passing data in a direction in accordance with a direction control signal at their control terminals; logic means responsive to said mode signal, said write signal and the value of said additional bit for providing said write enable signals, and logic means responsive to said mode signal, said read signal and the value of said additional bit for providing said direction control signals.

11. A display control apparatus as defined in claim 10, wherein said transceiver means comprises a first transceiver coupled to a first plurality of said data I/O ports and to a first plurality of bit positions of said host processor data bus and receiving a first direction control signal, a second transceiver coupled between a second plurality of said data I/O ports and said first plurality of bit positions of said host processor data bus and receiving a second direction control signal, a third transceiver coupled between said second plurality of data I/O ports and a second plurality of bit positions of said host processor data bus and receiving said second control signal, and further logic means responsive to said mode signal for selectively enabling only one of said second and third transceivers.

12. A display control apparatus as defined in claim 1, wherein:

said reading means comprises a line counter for counting line signals and providing at least a portion of its output as a line count address to said storage means, a pixel counter for counting pixel signals and providing at least a portion of its output as a pixel count address to said storage means, and a first multiplexer means for selectively providing any one of a plurality of pixel counter outputs as line count signals to said line counter in accordance with a mode signal; and said control means comprises a first register for storing clear data representing shift registers to be enabled, a control shift register for receiving said clear data and serially shifting said clear data in accordance with a shift signal, the contents of said control shift register being provided in parallel as enabling signals to said plurality of shift registers, and second multiplexer means responsive to said mode signal for providing selected outputs from said pixel and said shift signal.

* * * * *